United States Patent [19]

Comparat et al.

[11] Patent Number: 4,954,710

[45] Date of Patent: Sep. 4, 1990

[54] PARALLAX-FREE GAS DETECTOR FOR X-RAYS

[75] Inventors: Vincent Comparat, Grenoble; Jean Ballon, Moirans; Pierre Carrechio, Saint Martin le Vinoux; Alain Pelissier, Fontaine, all of France

[73] Assignees: Centre National de la Recherche Scientifique, Paris; Societe Inel, Les Ulis, both of France

[21] Appl. No.: 343,627

[22] Filed: Apr. 27, 1989

[30] Foreign Application Priority Data

Apr. 27, 1988 [FR] France ..... 88 06018

[51] Int. Cl.[5] ..... H01J 47/02

[52] U.S. Cl. ..... 250/385.1; 250/374; 250/375

[58] Field of Search ..... 250/385.1, 374, 375

[56] References Cited

U.S. PATENT DOCUMENTS 4,595,834 6/1986 Burns ..... 250/374

FOREIGN PATENT DOCUMENTS 2363117 8/1976 France ..... 250/385.1

OTHER PUBLICATIONS

P. F. Christie, E. Mathieson and K. D. Evans, "An x-ray imaging proportional chamber incorporating a radial field drift chamber," *Journal of Physics E: Scientific Instruments*, vol. 9, (1976), pp. 673–676, ©1976.

U. Nauenberg and G. Schultz, "Parallel Wire Drift Chamber With Variable Field Shaping Wire Voltages," *Nuclear Instruments and Methods*, vol. 137, No. 2 (Sep. 1, 1976), pp. 213–217, ©North-Holland Publishing Co.

G. Charpak, Z. Hajduk, A. Jeavons, R. Stubbs, "The Spherical Drift Chamber for X-Ray Imaging Applications," *IEEE Transactions on Nuclear Science*, vol. NS-22, (Feb. 1975), pp. 269–271.

G. Charpak, Z. Hajduk, A. Jeavons, R. Stubbs and R. Kahn, "The Spherical Drift Chamber for X-Ray Imaging Applications," *Nuclear Instruments and Methods*, vol. 122, No. 3, (Dec. 15, 1974), pp. 307–312, ©North-Holland Publishing Co.

"A Spherical Drift Chamber Area Detector for X-ray Crystallography", C. Bolon et al., *IEEE Transaction on Nuclear Sciene*, vol. NS-26, No. 1, Feb. 1979.

"Development of a MultiWire Proportional Chamber as an Area Sensitive Detector for X-ray Protein Crystallography", D. Bade et al., *Nuclear Instruments & Methods*, vol. 201(1982), pp. 193–196.

G. Charpak, "Parallax-Free High-Accuracy Gaseous Detectors for x-Ray and VUV Localization", *Nuclear Instruments and Methods*, (1982), pp. 181–192.

*Primary Examiner*—Constantine Hannaher

*Attorney, Agent, or Firm*—Lowe, Price, LeBlanc, Becker & Shur

[57] ABSTRACT

An X-ray gas detector for analyzing a material by studying X-ray diffraction. In order to minimize the parallax error without resorting to auxiliary electrodes, difficult to manufacture, a radial field in the whole gas space (40) is generated only by means of input electrodes (36) set to appropriate voltages and by means of lateral electrodes (44) also individually set to appropriate voltages. By modifying the voltages, it is also possible to move the center of the spheric equipotentials for permitting the analysis without parallax error of samples (20) placed at variable distances (D) from mthe input window (32) of the detector.

10 Claims, 5 Drawing Sheets

PARALLAX-FREE GAS DETECTOR FOR X-RAYS

BACKGROUND OF THE INVENTION

The invention relates to detectors of ionizing radiations, especially X-rays, and more particularly gas detectors, that is, those for which the material absorbing the radiations for generating electrons is a gas (for example comprising argon or xenon).

This type of detector is for example used for analyzing samples of material (metal alloys, proteins, crystalline structures, biological macromolecules, etc.) in order to determine the structure thereof. The samples are placed in front of the detector and laterally lighted (as a rule) by an X-ray source; they diffract the radiations and send them back to the detector and the function of the latter is to determine the angle of incidence according to which it receives the X-rays, that is, the diffraction angle due to the sample. The measured diffraction angles supply information on the structure of the sample material.

The known two-dimensional gas detectors have a structure which is generally shown in FIG. 1. They correspond for example to what is described in FIG. 1 of U.S. Pat. No. 4,595,834.

The detector comprises an air-tight chamber 10 containing the absorbing gas and, on the rear face, an air-tight input window 12, transparent to the X-rays. This window carries a transparent electrode 14 set to a voltage V1. Between the window 12 and the bottom of the chamber 10 a space 16 extends, called absorption and drift space, filled with gas (argon or xenon with polyatomic additives).

At the bottom of the chamber, opposite to window 12, an electron detector 18 is placed, called "localization detector" because of its function which is to detect the presence and the position of an electron package originating from the ionization of the gas in the chamber. This detector 18 comprises an electron-transparent input electrode 19, set to a voltage V2 higher than V1 (for example 0 volt if V1 is at −4,000 volts and if the distance between the electrodes 14 and 19 is about 10 cm).

A sample of material 20, placed outside the chamber, in front of window 12 and at a determined distance of the latter, is laterally lighted by an X-ray source 22.

Through diffraction, a photonic radiation 24 is reemitted from the sample towards the absorbing gas with an angle of incidence that is desired to be known.

After entering the gas, a photon will be absorbed at a point of the chamber and at this point it will emit an electron or an electron package. The electric field in the absorption and drift space is generated by the voltage difference V2−V1 so that the electrons may derive, along the field lines, towards detector 18 and their arrival position is detected. The field lines are straight lines perpendicular to electrodes 14 and 19.

As it will be seen in FIG. 1, according as the incident photon is absorbed at a point A or at a point B of its path, the electron detector 18 will detect an arrival position a or b of an electron package.

This means that it is not possible to univocally determine the incidence angle of the radiation 24 from the arrival position.

There is a so-called parallax error because the electric field which causes the electrons to derive is not orientated in the same direction as the incident ray 24.

SUMMARY OF THE INVENTION

The present invention aims at realizing a two-dimensional radiation detector free of parallax error.

Partial solutions to this problem have already been proposed.

Some are disclosed in the above-mentioned U.S. Pat. No. 4,595,834.

One theoretical solution is simple : it would consist in realizing a spherical chamber with a spherical input electrode and an electron localization detector also spherical and concentric with the input electrode, the sample being placed at the center of these spherical elements. The electrons are then driven in the direction of the incident radiation. There is no parallax error.

However, it is not possible to manufacture a spherical localization detector large enough because those detectors have a very complex technology (they are generally made of very thin wires that can be drawn in a plane but that cannot be bent).

FIG. 2 of the above-mentioned U.S. Pat. No. 4,595,834 provides for the realization of a radial electric field (that is, spheric equipotentials) by using a spheric input electrode, a spheric concentric auxiliary electrode, the absorption and drift space being limited by those two electrodes, and a transfer space being provided between the spheric auxiliary electrode and the localization detector which is plane.

The voltage difference between the two electrodes generates a radial electric field and spheric equipotentials in the absorption space.

But the sample must unavoidably remain at the center of the spheres.

Moreover, the spheric electrodes are difficult to realize, especially the auxiliary electrode because it must be highly electron-transparent since the electrons have to reach the localization detector; it is therefore made in the form of a thin wire-grid which is difficult to manufacture.

That is why the U.S. Pat. No. 4,595,834 provides for suppressing the auxiliary electrode by bringing very close from each other the input electrode and the localization detector and by increasing the gas pressure.

The parallax error is reduced by forcing the X-rays to be absorbed near the spheric input electrode where the field is roughly radial. This is achieved by using xenon at a high pressure and it restricts the use of such a system to not too highly energetic X-rays and requires the use of a window made of substantially thick spheric beryllium. In order to maintain the pressure, this window necessarily has a limited size.

Finally, another method provided by G. Charpak in "Nuclear Instruments and Methods" 1982, No. 201, pages 181–192, North-Holland Publishing Company, for supplying a radial electric field without spheric electrode has to be pointed out. It consists in replacing each of the input spheric electrode and the spheric auxiliary electrode of the U.S. Pat. No. 4,595,834 by a set of plane electrodes set to voltages different the one from the other, the voltages being calculated for each individual electrode in such a way that the equipotentials in the whole absorption space be spheric and centered on the sample. This method permits to change the radius of curvature of the equipotentials and therefore the sample position with respect to the input window of the detector by allowing the voltages to vary on the various conductors. However, the realization of the set of auxiliary electrodes placed right in the middle of the chamber is very complex (they have to be electron-transparent) and an attempt to realize it has been devised by the inventor for obtaining cylindric and non-spheric equipotentials only. Charpak has also suggested to use lateral electrodes, but only in association with an auxiliary (output) electrode.

The present invention provides for a new X-ray detector permitting to avoid the drawbacks of the gas detectors of the prior art and especially to allow to position a sample at a varying distance from the input window, while minimizing the parallax error and simplifying the manufacturing.

According to the invention, one provides a gas detector for radiations emitted by a sample, comprising a closed chamber containing a gas absorbing the radiations, an input window transparent to the radiations to be detected, an absorption and drift space behind the input window and, at the extremity of this space, a two-dimensional plane electron localization detector for determining the coordinates of an arrival point of electrons generated by a photon impact in the absorbing gas, the detector further comprising a set of input electrodes placed behind the input window and highly radiation-transparent; this detector further comprises a set of lateral electrodes surrounding the absorption and drift space, the individual input electrodes and the individual lateral electrodes being set to voltages different the ones from the others and varying as a function of the position where it is desirable to place a sample with respect to the input window, the determined voltages for each of the electrodes being such that the absorption and drift space is shared into two parts without resorting to electrodes physically delimiting this separation, the equipotentials in the first part being spheric or quasi-spheric and centered on the position of the sample, and the equipotentials in the second part continuously varying from a spheric shape, at the separation place, to a plane shape at close proximity of the electron plane detector.

According to the invention, one avoids the drawback of manufacturing and arranging a set of complex auxiliary electrodes wherein each of the individual electrodes has to be separately fed and has to be highly electron-transparent.

It will be possible to provide that the first part of the absorption space (part with spheric equipotentials) be as large as possible; thus, an extended absorption area will be available without increasing the overall size of the detector; this is all the more easy as the sample is far from the input window (but then only a low range of radiation incidence angles can be detected); when the sample is close to the window, it is possible to obtain a first part extending over 70 to 90% (percentage measured in the axis of the detector) of the distance between the input window and the electron detector. By choosing a distance large enough between the input window and the detector, for example 10 cm, practically all the X-rays will be absorbed in the first part and this at a pressure equal or slightly higher than the atmospheric pressure.

A radiation detector is thus achieved, the manufacturing of which is much simpler, exhibiting no parallax error and permitting to position the sample to be observed at a varying distance from the input window.

The lateral electrodes of the chamber will be preferably formed on the conical lateral walls laterally delimiting the absorption and drift space.

Preferably, the input electrodes are formed by silk screening on an insulating substrate and are separated from one another by a highly resistive substance permitting the flowing of the ionization electric charges which are liable to be accumulated between the electrodes.

BRIEF DESCRIPTION OF THE DRAWINGS

The foregoing and other objects, features, advantages of the invention will be apparent from the following detailed description of preferred embodiments as illustrated in the accompanying drawings wherein.

DETAILED DESCRIPTION OF THE INVENTION

Figure 1:
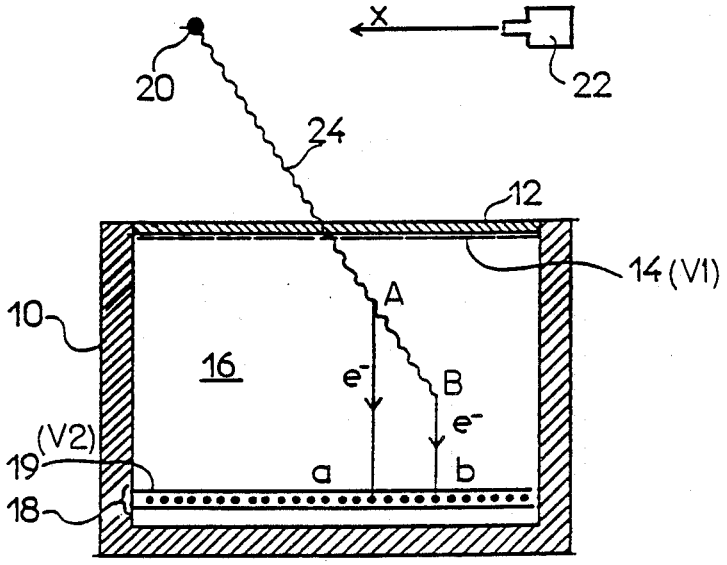
Fig 1 (PRIOR ART)
FIG. 1, already described, shows the general structure of a known type of a gas detector.
Figure 2:
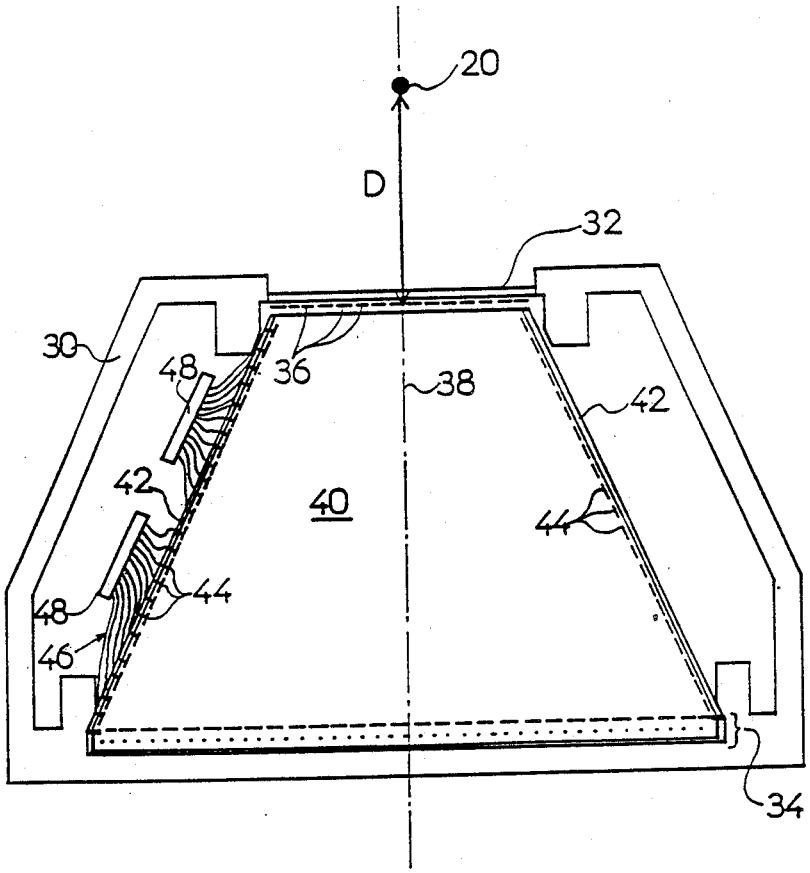
FIG. 2 is a schematic side view of the detector according to the invention.

FIG. 2 shows the general structure of the detector according to the invention.

The detector comprises an airtight external chamber 30 closed on the front part by an input window 32 transparent to the X-rays (or more generally transparent to the radiation to be detected). The window is for example made of Mylar or Kapton (registered trade names for polymeric films) or of beryllium.

The bottom of chamber 30 comprises as in the prior art a plane electron detector 34 which is a two-dimensional localization detector, for example a wire-detector with parallel plates or any other known type of gas detector.

On the backside of input window 32, a set of input electrodes is placed, which are as a rule circular, concentric and in the same plane, parallel to the plane of the electron detector. The fact they are all in the same plane renders manufacturing easier but this is not imperative. They may be placed for example on a spheric surface. Those input electrodes are referenced 36. They are better shown in a plane view in FIG. 4. The middle of the input circular electrodes is placed on the general axis 38 of the system (axis perpendicular to the electron detector 34 in its center).

The input electrodes 36 are liable to be carried by an X-ray-transparent support distinct from the input window 32 or to be applied on the window, with the insertion of an insulating layer if the window is conductive.

The chamber 30 is filled with gas absorbing the radiation to be detected for example with argon or xenon with one or several additives (hydrocarbon, $CO_2$, etc.) permitting a proper operation of the localization detector 34 and exhibiting satisfactory drift characteristics and the absence of a too high electronic recombination which would impair the collection of the electrons.

In the chamber, an absorption and drift space 40 is physically delimited, between the input electrodes 36 and the electron detector 34, by a generally conical lateral wall 42, having as an axis the general axis 38 of the detector; this wall 42 surrounds the whole absorption and drift space wherein the electrons will be liable to be generated by an incident radiation and then directed towards the electron detector 34.

Choosing a conic shape is the most convenient and suitable choice for the desired purpose, but it is not imperative.

The conic lateral wall 42 does not need to be airtight; it only serves as a base for the lateral electrodes 44 which surround the absorption and drift space 40.

The wall 42 may for example be a glass fiber sheet whereon conductors constituting the electrodes 44 are deposited, for example by silk screening or by printed circuit techniques.

The individual input electrodes 36 and the lateral individual electrodes 44 are liable to be set to voltages that are all different the ones from the others, those voltages being liable to vary as a function of the distance where the sample 20 to be observed will be placed with respect to the input electrodes 36.

The lateral electrodes 44 are distributed over the whole length of the wall 42, between the small extremity of the cone (immediately adjacent to the plane of the input electrodes) and the large extremity of the cone (immediately adjacent to the plane of the electron detector).

The lateral electrodes are circular, centered on the axis 38 of the detector.

The number of electrodes 36 and 44 is a function of the desired accuracy on the electric field inside the absorption and drift space.

The individual voltages of the lateral electrodes are led by conductors 46 external to wall 42, through conductive passages provided in the wall in front of each electrode. The external conductors 46 are connected with connectors 48 through which the various required voltages can be fed. The voltages can be generated by resistive dividing bridges, placed outside chamber 30 and preset as a function of the needs for the desired sample distances, or still through a more complex voltage generation system externally controlled by the user of the detector.

The connection system is the same for the input electrodes but has not been shown for the sake of simplification of FIG. 2.

Figure 3:
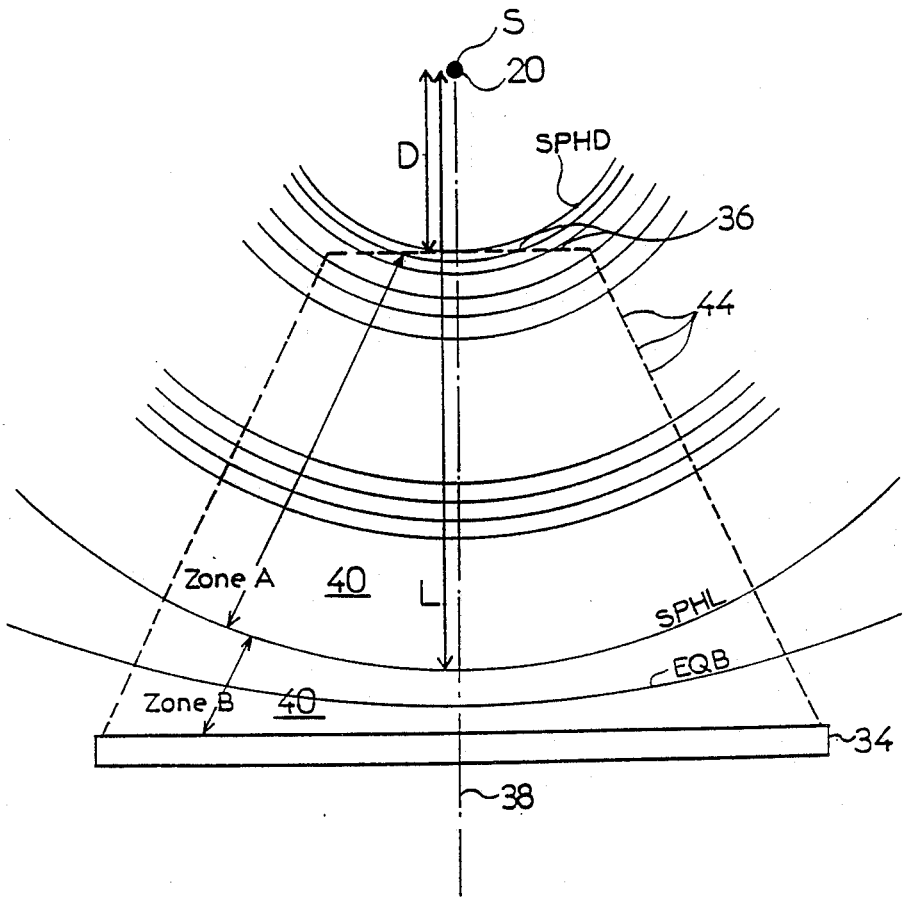
FIG. 3 shows a schematic configuration of equipotentials in the detector according to the invention.

The voltages that are to be applied to the various input electrodes 36 and to the various lateral electrodes 44 are calculated in the way that will be now disclosed: the explanation is given with reference to FIG. 3.

One chooses a distance D where the sample 20 to be observed will be placed (distance between the sample and the plane of the input electrodes 36) and SPHD is the sphere centered on the position of the sample and having a radius D.

One chooses a distance L corresponding to the radius of a virtual sphere SPHL centered on the position S of the sample, this sphere SPHL constituting a non-physical separation between two regions A and B of the absorption and drift space 40. The voltages to be applied to electrodes 36 and 44 will be chosen so that:

region A, positioned between the input electrodes 36 and the limit sphere SPHL, is submitted to a radial electric field centered on point S, that is, the equipotentials will be spheres concentric to sphere SPHL; and region B, positioned between the limit sphere SPHL and the plane electron detector 34, is submitted to an electric field progressively changing from a radial direction to a direction perpendicular to the plane of the electron detector 34. In this region B, the shape of the equipotentials will change from a substantially spheric shape at the close proximity of the sphere SPHL to a plane shape at the close proximity of the detector 34.

It is to be noted that the radial electric field is generated not only owing to the lateral electrodes 44 positioned inside the sphere SPHL, but also owing to an appropriate choice of the voltages of the lateral electrodes 44 placed outside the sphere SPHL; this remark is important because the absence of a physical spheric auxiliary electrode at the place of the limit auxiliary sphere SPHL or the absence of plane auxiliary electrodes between the regions A and B for simulating a spheric electrode, imposes to pay also a particular attention to the voltages applied to the lateral electrodes 44 placed outside the limit sphere SPHL. The spheric equipotentials at the neighbourhood of the limit sphere SPHL are indeed particularly sensitive at the proximity of the plane detector and they are not insulated by an electrostatic screen that the auxiliary electrode(s) placed in the limit region between the regions A and B has (have) constituted up to now.

By means of simple electrostatic methods, one determines the equipotentials betweeen two concentric conductive spheres centered on point S, one being a departure sphere SPHD having a radius D and the other the limit sphere SPHL having a radius L.

For a voltage VD imposed on the sphere SPHD and a voltage VL imposed on the sphere SPHL, one obtains according to a first calculation:

on the one hand, the values of the voltages on all the intermediate concentric spheres of the region A, the value of voltage V(R) on an intermediate sphere having a radius R being:

$$V(R)=(VD-VL)\times L\times D/R(L-D)+(L\times VL-D\times VD)/(L-D) \quad (1)$$

on the other hand, the value of the electric field on the sphere SPHL; this field E is proportional to the voltage difference VL −VD and equal to:

$$E=(VL-VD)\times D/(L-D)\times L \quad (2)$$

In the same way, according to a second calculation, one determines, by the electric images method, the equipotentials in the region B between a sphere SPHL set to a constant voltage VL and the plane of detector 34, set to a fixed voltage; the electric field on the sphere SPHL is calculated as a function of VL and VF.

For given values of VD and VF, one calculates the VL value that permits the obtention of substantially equal values for:

on the one hand, the electric field calculated on the sphere SPHL from spheric equipotentials in the region A, limited by two spheres at voltages VD and VL, on the other hand, the electric field calculated on the sphere SPHL from the voltages in the region B, determined by limit conditions which are the voltage VL on sphere SPHL and the voltage VF in the plane of the electron detector 34.

Since the electric field determined by the first calculation is constant on the whole sphere SPHL (proportional to VL−VD) and since the electric field determined by the second calculation is not constant on the whole sphere SPHL, the above-mentioned identity condition is not strictly possible; but one can choose the value of VL for example in such a way that the electric field at the intersection of the sphere SPHL and axis 38 of the detector is identical in both calculations.

For this value of VL a satisfactory approximation will be achieved for obtaining spheric or quasi-spheric equipotentials on the whole region A.

Once the most appropriate value of VL has been chosen, one uses again equation (1) for determining the voltages in region A by the first calculation (limit conditions imposed by two spheres) and in region B by the second calculation (limit conditions imposed by one sphere and one plane). The voltages are then determined:

at the intersection between the spheric equipotentials and the plane of the input electrodes 36 (region A: first calculation)

at the intersection between the spheric equipotentials of the whole region A and the lateral walls 42 of the absorption and drift space (region A: first calculation)

at the intersection between the non-spheric equipotentials of region B and the lateral walls 42 beyond the limit sphere SPHL (region B: second calculation).

The intersections between the spheric equipotentials and the plane of the input electrodes are concentric circles and the input electrodes follow the drawing of some of those circles. An input electrode 36 placed at a distance r from the sample will be set to a voltage V(r) calculated by the equation (1) for this distance, as a function of the chosen values VD and VL:

$$V(r)=(VD-VL)\times L\times D/r(L-D)+(L\times VL-D\times VD)/(L-D) \quad (1)$$

Similarly, the intersections between the spheric equipotentials of region A and the conic lateral walls 42 are parallel circles centered on axis 38; the lateral electrodes 44 follow the drawing of some of those circles and each electrode placed at the distance r from the sample will be set to the voltage V(r) obtained by the equation (1).

Lastly, the intersections between the equipotentials of region B and the lateral walls 42 are again circles (for the sake of symmetry); the lateral electrodes 44 of region B follow the drawing of some of those circles and are set to voltages calculated by the electrostatic images method (second calculation) as a function of the position of those circles.

FIG. 3 shows, in addition to the spheric equipotentials of region A, an intermediate equipotential EQB of region B, which is not a sphere centered on point S.

When such voltages are applied to each of the input electrodes 36 and of the lateral electrodes 44 inside and outside of the limit sphere SPHL, equipotentials are obtained which approach with a satisfactory approximation the equipotentials from which the voltages have been calculated.

It is possible to obtain still better results by taking the above determined voltage values for electrodes 36 and 44 as a starting basis for an optimization of the equipotentials with the help of a numerical computer program resolving the Laplace equation. Thus, one modifies by an iterative method the values of the voltages on electrodes 36 and 44 in order to render the equipotentials as close as possible to the perfect spheres in region A.

It will be noted, as regards the lateral electrodes 44 placed in region B, that satisfactory results can be obtained in practice even if one merely applies thereto the voltages varying linearly with the distance between the sphere SPHL and electrode 34. In that case, one gets rid of the above-mentioned second calculation but it will still be possible to carry out an interative optimization.

The distance D at which the sample to be observed is placed is liable to be changed; as a result, a new preferential distribution of the voltages to assign to the input electrodes 36 and to the lateral electrodes 44 occurs. Therefore, it is possible to move the position of the sample while keeping the spheric equipotentials, centered on the sample, in the largest part of the absorption and drift space 40.

If the sample is not placed too close to the input window, one obtains practically spheric equipotentials in a region A liable to extend up to about 90% of the distance between the input electrodes and the electron detector (distance measured along axis 38 of the detector).

If the sample is very close, the extension of region A is liable to decrease down to 70% of this distance.

Figure 4:
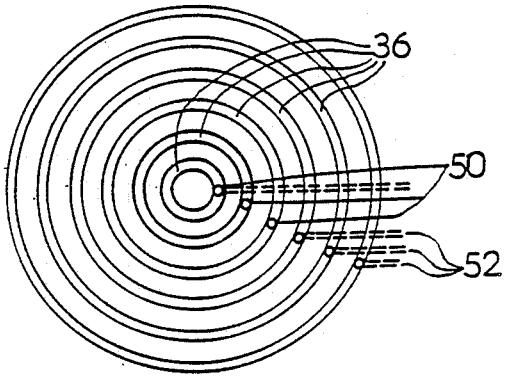
FIG. 4 is a plane view of the input electrodes.

FIG. 4 shows the configuration of the input electrodes 36. They are conductive concentric circular paths. In this example, they are realized by silk screening of a carbon conductive paste (carbon having the advantage of being substantially transparent to X-rays) on an insulating support.

The individual electrodes are supplied by conductors placed on the other side of the support. The support is then pierced with holes 50 filled with conductive paste and the supply conductors 52 are electrically connected to those holes. The supply conductors are liable to be formed by silk screening on the other side of the insulating support. They have to be as transparent as possible to the radiations to be detected.

Figure 5:
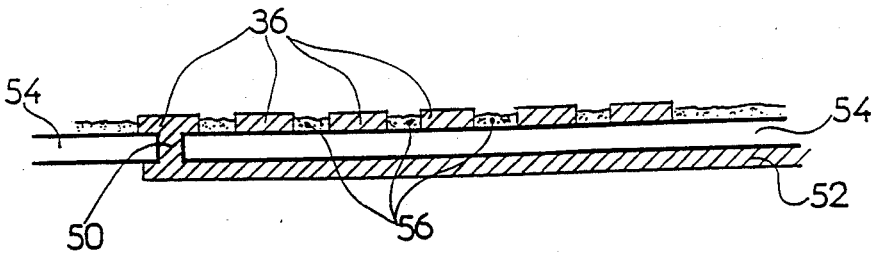
FIG. 5 is an enlarged lateral section view of the input electrodes and of the current conductors.

FIG. 5 shows the configuration of the input conductors in a transversal side view perpendicularly to the plane of the input window, through one only of the conductive passages 50 and along the current conductor 52 which is connected to this hole. The insulating support is referenced 54.

Preferably, one deposits between the circular conductive paths constituting the electrodes 36 a highly resistive paste 56 designed to drain off towards the electrodes 36 the electrical charges (ions) which are liable to accumulate at the interface between the insulating substrate 54 and the gas of the chamber. Those charges originate from the gas ionization and impair the shape of the equipotentials towards the detector input if they remain stored on the insulating substrate. It is thereby provided to drain them off through this resistive deposition between the conductive paths. The resistance may be of a few megohms between two adjacent paths separated by a few millimeters. Of course, it must not cause a too important current consumption and it is necessary to ensure that the adjacent paths may be set to voltages varying in a range of several tens volts or even more. The highly resistive paste can be a paste having a low carbon proportion in an insulating resin.

It is also possible to devise that the conductive electrodes 36 be directly deposited (by silk screening for example) on a resistive substrate (highly resistive) and not insulating; the same result could be obtained as regards the draining off of the impeding charges.

For the lateral electrodes 44, the structure is liable to be the same as the one of the input electrodes but 1. there is no problem as regards X-ray transparence;
2. the problem of the electric charges to be drained off is less critical; the resistive paste 56 is useful but not compulsory.

The lateral electrodes 44 can be deposited by silk screening on an insulating flexible sheet constituting the lateral wall 42; this flexible sheet is then rolled up in a truncated cone shape. The electrodes can also be realized in the form of a flexible printed circuit or by piling up circular electrodes separated by insulating spacers. The connections with the supply conductors will however be still outside space 40 in order not to impair the electric field on the inner side of the lateral wall 42.

Figure 6:
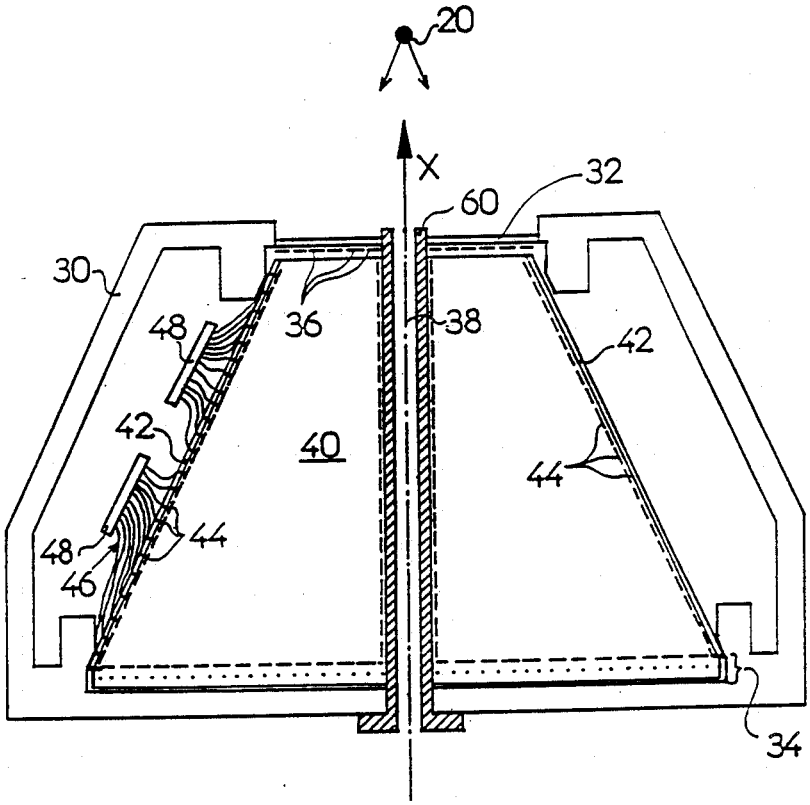
FIG. 6 shows a realization of a central-tube detector for analyzing the retrodiffraction of the sample.

To complete this description, FIG. 6 shows a slightly different detector structure, wherein one tries to analyze the X-ray rear diffraction by a sample of material.

Then, it is imperative that the source and the detector be positioned on the same side of the sample.

It has therefore been provided that the detector be pierced in its center by an axial bore 60 through which an X-ray beam can flow in the direction of the sample 20. The beams reemitted backward by the sample are trapped and analyzed by the detector.

For implementing the invention, it is then necessary to consider that the walls of the tube 60 are also lateral walls of the absorption and drift space 42, and that they also carry the individual lateral electrodes 44; those electrodes are set to voltages that are calculated in the same way as the others, both in the upper region and in the lower region of the chamber.

The connections for setting the voltages to the different electrodes along the tube are carried out with the same constraints as above, and it is also desirable to provide for a resistive material between the electrodes at the periphery of the tube.

We claim:

1. A gas detector for radiations emitted by a sample (20), comprising a closed chamber (30) containing a gas absorbing the radiation, an input window (32) transparent to the radiations to be detected, an absorption and drift space (40) behind the input window and, at the extremity of this space, a plane two-dimensional detector for the localization of electrons (34) for determining the coordinates of an arrival point of electrons generated by a photon impact in the absorbing gas, the detector further comprising a set of input electrodes (36) placed behind the input window and highly radiation-transparent, further comprising a set of lateral electrodes (44) surrounding the absorption and drift space, the individual input electrodes (36) and the individual lateral electrodes (44) being set to voltages different the ones from the others and variable as a function of the position where it is desirable to place the sample with respect to the input window, the voltages determined for each of the electrodes being such that the absorption and drift space is shared into two parts without using electrodes physically delimiting this separation, the equipotentials in the first part being spheric or quasi-spheric and centered on the position of the sample, and the equipotentials in the second part being continuously variable from a spheric shape, at the place of the separation, to a plane shape at close proximity of the plane electron detector.

2. A gas detector according to claim 1, wherein the lateral electrodes (44) are distributed on the whole distance separating the input electrodes (36) from the electron detector (34).

3. A gas detector according to claim 1, wherein the first part (A) of the absorption and drift space extends over a distance of about 70 to 90% of the distance between the input electrodes (36) and the electron detector (34), said distance being measured along the axis of the detector.

4. A gas detector according to claim 2, wherein the voltage values of the different input electrodes and of the different lateral electrodes result from a caculation carried out in the following manner:

(a) determining the equipotentials between a sphere having a radius corresponding to the distance (L) between the sample and the interface of the first and second parts of the absorption and drift space set to a voltage VL and a concentric sphere having a radius corresponding to the distance (D) between the sample and the input window set to a voltage VD, (b) setting the potential of the input electrodes (36) and lateral electrodes (44) placed in the first part as a function of said determination, and (c) setting the potential of the electrodes placed in the second part by means of linear interpolation.

5. A gas detector according to claim 2, wherein the voltage values of the different input electrodes and different lateral electrodes result from a calculation carried out of the following manner:

(a) determining the equipotentials between a sphere having a radius corresponding to the distance (L) between the sample and the interface of the first and second parts of the absorption and drift space set to a voltage VL and a concentric sphere, having a radius corresponding to the distance (D) between the sample and the input window set to a voltage VD, (b) determining the equipotentials between the sphere set to a voltage VL and a plane set to a voltage VF, and (c) determining the resulting potentials at the places where the different electrodes are positioned, the voltage values assigned to the different electrodes being those resulting voltages.

6. A gas detector according to claim 5, wherein the voltage values of the different electrodes are the ones resulting from the additional calculation consisting in choosing the voltage VL in such a way that the electric field, at a point of the sphere set to a voltage VL, has the same value in the calculation carried out at step (a) and in the calculation carried out at step (b).

7. A gas detector according to claim 1, wherein the voltages at the input and lateral electrodes are optimized by an iterative calculation carried out by a computer.

8. A detector according to claim 1, wherein a highly resistive substance (56) is disposed between the input electrodes (36) for avoiding the storage of electric charges between two adjacent electrodes.

9. A detector according to claim 1, wherein the lateral electrodes (44) are formed on a conic wall (42) delimiting the absorption and drift space.

10. A detector according to claim 1, wherein said detector is provided with an axial tube (60) crossing it along its center for permitting the lighting of a sample and observing the rear diffraction, lateral electrodes (44) being also distributed along the tube wall in the absorption and drift space.

* * * * *